United States Patent [19]

Skipper

[11] Patent Number: 4,919,238

[45] Date of Patent: Apr. 24, 1990

[54] VARIABLE CENTRIFUGAL BRAKE

[76] Inventor: Hugh W. Skipper, High House, Parc-y Brian Rd., Penperlleni, Pontypool, Gwent, United Kingdom

[21] Appl. No.: 295,432

[22] Filed: Jan. 10, 1989

[30] Foreign Application Priority Data

Jan. 13, 1988 [GB] United Kingdom ..... 8800632
Nov. 1, 1988 [GB] United Kingdom ..... 8825553

[51] Int. Cl.[5] ..... B60T 7/12

[52] U.S. Cl. ..... 188/186; 182/234; 187/89; 188/180; 192/103 B; 192/105 CF; 272/131; 272/133

[58] Field of Search ..... 188/180, 186, 187; 192/103 B, 105 CE, 105 CF; 160/298; 182/234; 187/89; 272/131, 133

[56] References Cited

U.S. PATENT DOCUMENTS

| | | | |
|---|---|---|---|
| 666,609 | 1/1901 | Royal | 188/187 |
| 699,461 | 5/1902 | Dysterud | 192/105 CF |
| 1,378,206 | 5/1921 | Willson | 188/187 |
| 1,383,667 | 7/1921 | Rubsam | 188/187 |
| 2,453,854 | 11/1948 | Olcott | 188/186 |
| 2,475,178 | 7/1949 | Church | 192/105 CF |
| 4,602,699 | 7/1986 | Matt | 182/234 |
| 4,620,703 | 11/1986 | Greenhut | 272/131 X |

FOREIGN PATENT DOCUMENTS

| | | | |
|---|---|---|---|
| 2016652 | 12/1982 | Fed. Rep. of Germany | 272/131 |
| 241423 | 10/1925 | United Kingdom | 188/187 |

*Primary Examiner*—George E. A. Halvosa
*Attorney, Agent, or Firm*—Rodman & Rodman

[57] ABSTRACT

A variable centrifugal brake comprises a driven shaft carrying a disc with centrifugally-acting bob weights which bear against an axially displaceable bush, which in turn bears against a forked lever assembly, in turn bearing against a further lever carrying a friction lining engaging the periphery of the disc. The brake may be used in an exercise machine having a drum around which a pull cord is wound and a transmission for transmitting drive from the drum to the shaft of the brake.

2 Claims, 3 Drawing Sheets

VARIABLE CENTRIFUGAL BRAKE

This invention relates to a variable centrifugal brake having particular but not sole application to a physical exercise machine.

Variable brake units are known for controlling or regulating the rotary speed of external power inputs. It has been known to use such brake units in physical exercise machines. Such brake units do however suffer from various drawbacks including complexity, unreliability and inefficiency.

According to the invention there is provided a variable centrifugal brake, comprising a main drive shaft connected to an external power input which is required to be controlled, a disc keyed to the drive shaft, one or more bob weights arranged to resolve with the disc and transmit an axial force to a bush fitted on the drive shaft, and free to slide on it, a lever arm faced with a friction lining arranged to bear against the disc when moved about a pivot pin, a lever and fork assembly arranged to transmit force from the sliding bush to the lever bearing the friction lining, and a spring having an adjustable anchor point arranged to oppose the motion of the lever bearing the friction lining.

Also in accordance with this invention, there is provided a variable centrifugal brake, comprising a driven shaft, centrifugally acting means on the shaft, an element disposed on and axially displaceable along the shaft in response to the centrifugally acting means, a second element against which said axially displaceable element bears, and friction braking means responsive to movement of said second element, caused by movement of the axially displaceable element, to apply a braking force to the rotating shaft.

An embodiment of this invention will now be described by way of example only and with reference to the accompanying drawings, in which.

Figure 1:
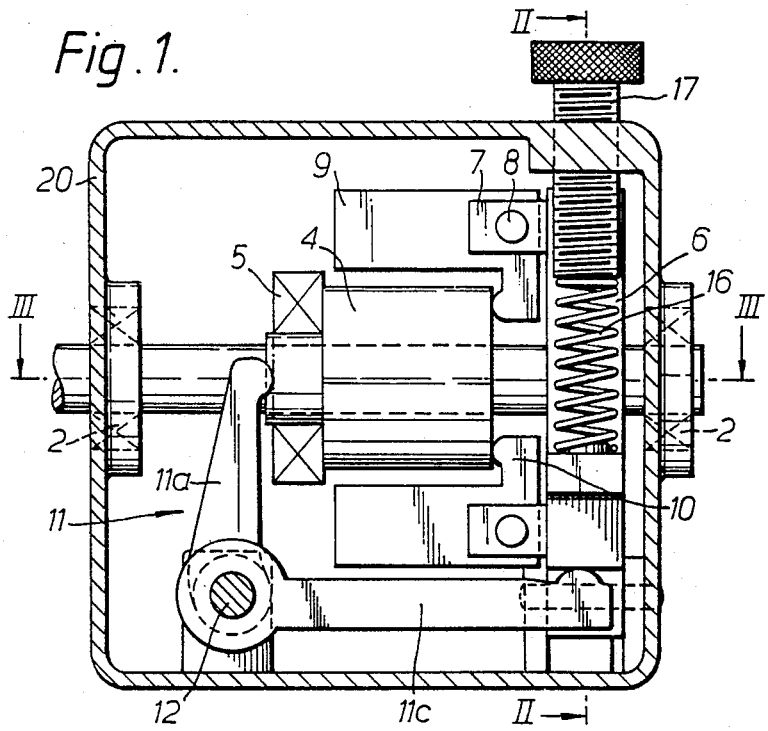
FIG. 1 is a section through a variable centrifugal brake in accordance with the invention, being a section on the line II of FIG. 3.
Figure 2:
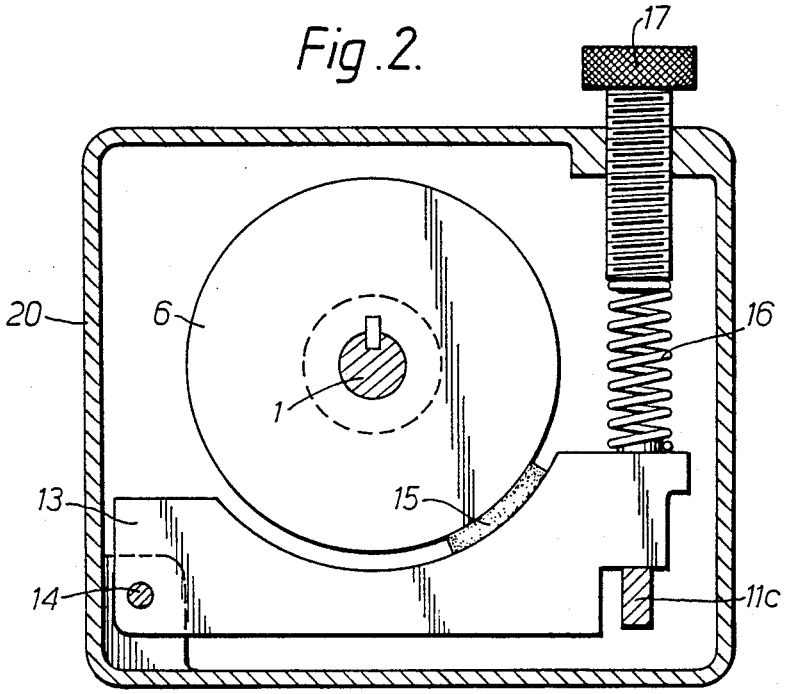
FIG. 2 is a section through the variable centrifugal brake on the line II II of FIG. 1.
Figure 3:
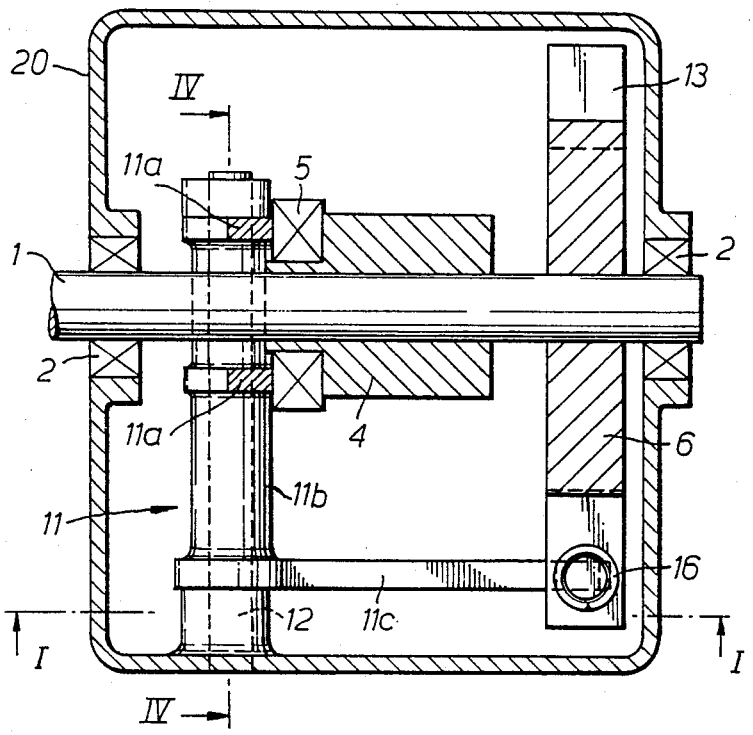
FIG. 3 is a section through the variable centrifugal brake on the line III III of FIG. 1.
Figure 4:
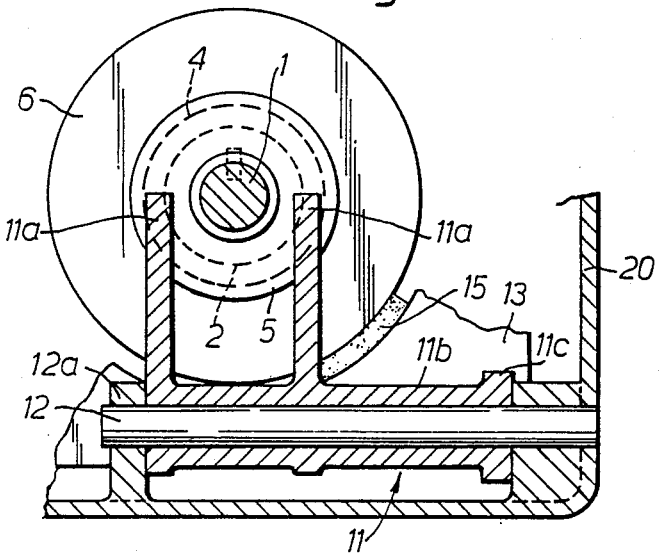
FIG. 4 is a section through part of the variable centrifugal brake on the line IV IV of FIG. 3.

Referring to FIG. 1 to 4 of the drawings, there is shown a variable centrifugal brake which comprises a housing 20 through which a main shaft 1 extends, the shaft 1 being journalled in bearings 2,2 mounted in opposite walls of the housing. A disc 6 is carried on the shaft 1 adjacent one of the bearings 2. The disc 6 is formed, on its side facing away from the adjacent bearing 2, with a number of projecting brackets 7 spaced at intervals around the circumference of the disc. A bob weight 9 is pivoted to each bracket 7 by means of a pin 8. A bush 4 is disposed on the shaft 1 and is free to slide along that shaft. The bob weights 9 have inwardly-directed arms 10 which bear against one end of the bush 4. The other end of the bush 4 is fitted with a thrust bearing 5.

A lever and fork assembly 11 is pivotally mounted by means of a shaft 12 extending between one side wall of the housing and a bracket **12*a* projecting from the base of the housing. The assembly 11 has a pair of upright forks 11*a* disposed to either side of the main shaft 1 and bearing against the outer side of the thrust bearing 5. The assembly 11 comprises a tubular portion 11*b* through which shaft 12 extends and having the forks 11*a* projecting from it adjacent one end. A lever 11*c* projects horizontally from shaft 12** adjacent its other end.

The brake further comprises a lever 13 disposed across the housing below the disc 6 and pivoted at one end by a pin 14 to a bracket projecting from the housing. The lever 13 has a surface which is curved to follow the periphery of the disc 6 and is faced with a friction lining 15. The free end of the lever **11*c* of the fork and lever assembly 11 engages the underside of the free end of the lever 13, in a notch in the latter. A bolt 17 is screw-threaded through the top of the housing and a compression spring 16 acts between the lower end of the bolt 17 and the upper side of the lever 13** adjacent its free end.

In operation, an exterior drive applied to the main shaft 1 causes the latter to turn. The bob weights 9 swing out on their pivot pins 8 and their arms 10 bear against the bush 4 to displace this bush along the shaft 1. The bush bears on the fork and lever assembly 11 via the thrust bearing 5, applying a force turning the lever portion **11*c*, which bears on the lever 13 to urge the friction lining 15 against the periphery of the disc 6. The bolt 17 is adjustable to control the return pressure exerted on the lever 13 by the compression spring 16, so that the degree of braking can be adjusted. It will be appreciated that once the adjustment bolt 17** is set, the degree of braking will increase with increasing speed of rotation of the input shaft, tending to regulate the speed of the latter.

Figure 5:
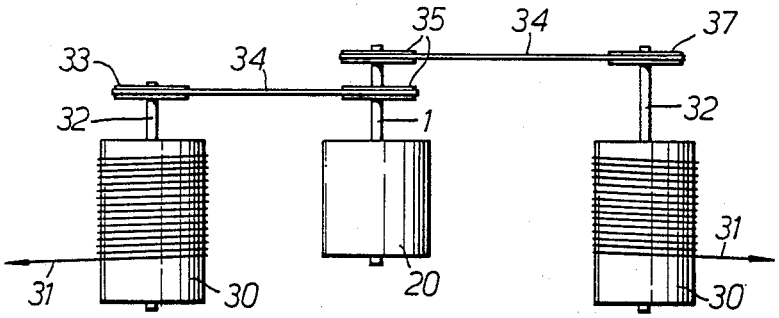
FIG. 5 is a diagrammatic plan view of a brake unit employed in an exercise machine.
Figure 6:
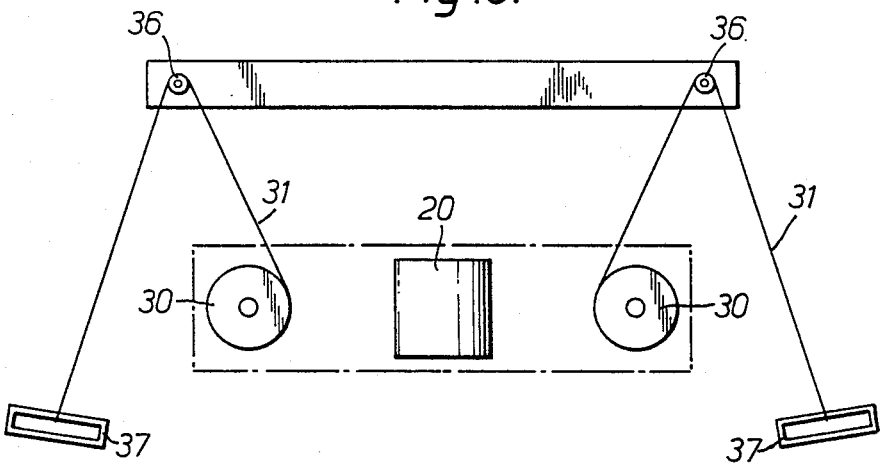
FIG. 6 is a schematic front view of the exercise machine.

One use of the variable centrifugal brake which has been described is in an exercise machine. A braking unit for such an exercise machine is shown in FIG. 5 and comprises two rotatably mounted drums 30, 30 around which rope cords 31, 31 are wound. The drums 30, 30 are carried on shafts 32, 32 which carry free-wheeling sprockets 33, 33. Chains 34, 34 transmit drive from the sprockets 33, 33 to sprockets 35, 35 on the shaft 1 of a variable centrifugal brake as shown in FIGS. 1 to 4. As shown in FIG. 6, the cords 31, 31 extend from the drums 30, 30 and over pulleys 36, 36 to grips 37, 37. A user wishing to exercise then holds the grips and pulls the cords 31, 31 alternately or together, depending on the type of exercise he wishes to carry out. For example, the apparatus may be used as a swimming exerciser but for a wide variety of other exercices instead. When a cord 31 is pulled, it causes rotation of the corresponding drum 30 and hence rotation of the main shaft 1 of the variable centrifugal brake, the action of which leads to a constant tension in the cord 31. When the pull on cord 31 is relaxed, a return spring within the drum causes the drum to rotate in the reverse direction to wind the cord up again onto the drum. However, the sprocket 33 free-wheels in from this direction of rotation of the drum and the variable centrifugal brake is relieved of any drive from the drum 30 whilst it is rewinding. The brake shaft 1 is turned in the same direction regardless of which of the two cords 31, 31 are pulled.

What is claimed is:

1. A variable centrifugal brake, comprising a main shaft having an axis and being connected to an external power input which the brake is required to control, a disc means keyed to the main shaft for rotation therewith, said disc means having a circular peripheral surface, a bush fitted to the main shaft, at least one weight pivotally mounted to the disc means to transmit an axial force to the bush as the disc means rotates, the bush being free to slide on the main shaft, a first lever arm mounted on a first pivot and having a portion faced with a friction lining which is arranged to bear against the circular peripheral surface of the disc means when the first lever arm is moved in a predetermined direction about the first pivot, a second lever in engagement with the first lever arm to move said first lever arm in said predetermined direction, said second lever being pivotally mounted on a second pivot and having a pair of forks with one fork portion at either side of the main shaft, and a thrust bearing carried on the bush to transmit the axial force from the bush to the forks to pivot the second lever and so move the second lever about the second pivot, and a spring having an adjustable anchor point and arranged to oppose movement of the lining-faced portion of the first lever arm towards the peripheral surface of the disc means.

2. An exercise machine comprising a rotatably mounted drum, a variable centrifugal brake having a drive shaft, the drive shaft having an axis, transmission means for transmitting drive from the drum to the drive shaft of the brake, and a pull cord wound around the drum and extending therefrom, the variable centrifugal brake comprising disc means keyed to the drive shaft for rotation with the drive shaft and having a circular peripheral surface, a bush fitted to the drive shaft, at least one weight pivotally mounted to the disc means to transmit an axial force to the bush as the disc means rotates, the bush being free to slide on the drive shaft, a first lever arm mounted on a first lever arm pivot and having a portion faced with a friction lining which is arranged to bear against the peripheral surface of the disc means when the first lever arm is moved about the first lever arm pivot, a second lever arm in engagement with the first lever arm to move said first lever arm about said first lever arm pivot, said second lever arm being pivotally mounted on a second lever arm pivot and having a pair of forks with one fork portion at either side of the drive shaft, and a thrust bearing carried on the bush to transmit an axial force to the forks to pivot the second lever arm in a predetermined direction and so move the second lever arm about its second lever arm pivot, and a spring having an adjustable anchor point and arranged to oppose movement of the lining-faced portion of the first lever arm towards the peripheral surface of the disc means.

* * * * *